US008947067B1

(12) United States Patent
Zarei

(10) Patent No.: US 8,947,067 B1
(45) Date of Patent: Feb. 3, 2015

(54) AUTOMATIC BANDGAP VOLTAGE CALIBRATION

(75) Inventor: Hossein Zarei, Irvine, CA (US)

(73) Assignee: Marvell International Ltd., Hamilton (BM)

( * ) Notice: Subject to any disclaimer, the term of this patent is extended or adjusted under 35 U.S.C. 154(b) by 348 days.

(21) Appl. No.: 13/349,218

(22) Filed: Jan. 12, 2012

Related U.S. Application Data

(60) Provisional application No. 61/434,262, filed on Jan. 19, 2011.

(51) Int. Cl.
*G05F 3/26* (2006.01)

(52) U.S. Cl.
USPC ..... 323/313; 323/316

(58) Field of Classification Search
CPC ..... G05F 3/26
USPC ..... 323/313, 315, 316
See application file for complete search history.

(56) References Cited

U.S. PATENT DOCUMENTS

| | | | | |
|---|---|---|---|---|
| 8,154,272 | B2 * | 4/2012 | Kim et al. | 323/314 |
| 2008/0067996 | A1 * | 3/2008 | Murase | 323/316 |
| 2009/0302824 | A1 * | 12/2009 | Kim et al. | 323/313 |
| 2012/0161744 | A1 * | 6/2012 | Kim et al. | 323/313 |

* cited by examiner

*Primary Examiner* — Jeffrey Sterrett

(57) ABSTRACT

Disclosed is bandgap voltage reference generator having a programmable resistor. The programmable resistor can be programmed to provide a proper ratio between the PTAT current and the CTAT current to reduce the effect of process variations on the bandgap voltage. The bandgap voltage reference generator includes a calibration circuit that programs the programmable resistor.

20 Claims, 8 Drawing Sheets

AUTOMATIC BANDGAP VOLTAGE CALIBRATION

CROSS REFERENCE TO RELATED APPLICATIONS

The present disclosure claims priority to U.S. Provisional App. No. 61/434,262 filed Jan. 19, 2011, the content of which is incorporated herein by reference in its entirety for all purposes.

FIELD OF THE DISCLOSURE

The present disclosure relates generally to voltage regulators and voltage references, and in particular to automatic calibration of bandgap voltage regulators.

BACKGROUND

Unless otherwise indicated herein, the approaches described in this section are not prior art to the claims in this application and are not admitted to be prior art by inclusion in this section.

An accurate bandgap voltage is required as a reference voltage in many applications. For example, a Digital to Analog Converters (DAC) and an Analog to Digital Converters (ADC) requires an accurate voltage reference. Output power measurement and calibration in a transmitter circuit is another example where an accurate voltage reference is required.

FIG. 1 shows an example of an automatic power control circuit 100 that employs a bandgap voltage reference. A digital block 102 generates an output which feeds into a transmitter 104. A power amplifier 106 amplifies the power of the signal produced by the transmitter 104. A coupler 108 couples the output of the power amplifier 106 to a switch 110 for transmission via an antenna 112. The coupler 108 provides a second output that goes into a detector 114, which detects a power level of the transmitter 104. An output of the detector 114 may be a DC voltage level $V_{DET}$ that is proportional to the detected power level. The $V_{DET}$ is compared to a reference voltage $V_{REF}$ that can be provided by a bandgap voltage reference circuit 116; e.g., using a comparison block 118. A voltage level output of the comparison block 118 is converted to a digital signal by an ADC 120. The digital signal may then serve as a power level feedback signal that the digital block 102 may use to subsequently adjust a transmission power level or some other aspect of the operation of the digital block. It can be appreciated that proper operation of the power control circuit 100 requires an accurate voltage reference $V_{REF}$. A bandgap voltage reference is thus an important circuit in many mixed-signal analog-digital and radio-frequency systems. It is not possible to make a precise comparison or conversion if the bandgap voltage reference is not constant.

Referring to FIG. 2, a typical bandgap voltage reference circuit is shown. The circuit typically includes two p-n junctions having different current densities. The circuit in FIG. 2, for example, the p-n junctions are provided by diodes D1 and D2 of different sizes, where the size of D2 is greater than the size of D1. An op-amp controls (via output $V_g$) two current sources to generate a current $I_C$ that is Proportional To the Absolute Temperature (PTAT) in a first resistor (e.g., R1) and to bias two diodes (D1 and D2). This forces a voltage $V_{BE1}$ to be the same as a sum of voltages $V_{BE2}+V_{R1}$. The op-amp output ($V_g$) also controls a third current source to generate the current $I_C$ to produce a voltage in a second resistor (e.g., R2) and bias another diode (D3). This voltage drop across R2 is added to the voltage across another p-n junction (e.g., diode D3) to generate the band-gap voltage ($V_{BG}$).

When a diode that is operated at constant current (e.g., where current does not depend on any process corner from one chip to another), the voltage across that diode is inversely proportional (Complementary) To Absolute Temperature (CTAT); i.e., the voltage decreases with increasing temperature. Here, the constant current is the PTAT current $I_C$, which is only dependent on the temperature. If the ratio between the first resistor (R1) and the second resistor (R2) is chosen properly, the first order effects of the temperature dependency of the diode D3 and the PTAT current $I_C$ will cancel out. In other words, the negative slope (negative temperature coefficient) of the voltage vs. temperature curve of diode D3 ($V_{BE3}$) is compensated by the positive slope (positive temperature coefficient) of the temperature variation of a voltage difference between the diodes D1 and D2, namely ($AV_{BE1,2}=V_{BE1}-V_{BE2}$).

The output voltage $V_{BG}$ of the circuit shown in FIG. 2 is obtained as follows:

$$V_{BG}=V_{BE3}+I_C\times R_2, \quad \text{Eqn. 1}$$

where $V_{BG}$ is the bandgap voltage, $V_{BE3}$ is the voltage across diode D3, $I_c$ is the current generated by the current source, and $R_2$ is the resistance of the resistor R2.

The op-amp will force $V_{BE1}$ to be same as $V_{BE2}+I_C\times R_1$ and so:

$$I_C\times R_1=V_{BE1}-V_{BE2}=\Delta V_{BE1,2}, \quad \text{Eqn. 2}$$

where $V_{BE1}$ and $V_{BE2}$ are voltages across respective diodes D1 and D2. A diode is typically fabricated using a bipolar transistor by connecting together the base and collector of the transistor. For a bipolar transistor (and therefore for the diode), the collector current ($I_C$) can be expressed as:

$$I_C=I_s\times e^{(V_{BE}/V_T)}, \quad \text{Eqn. 3}$$

where $I_S$ is the saturation current for the bipolar transistor, and $V_T$ is equal to $$\frac{kT}{q},$$

where k is the Boltzmann constant, q is the electron charge, and T is absolute temperature in units of Kelvin.

Therefore, the difference between the base-emitter voltages ($\Delta V_{BE1,2}$) of two bipolar transistors configured as diodes D1 and D2 can be expressed as:

$$I_C\times R_1 = V_{BE1} - V_{BE2} = \Delta V_{BE1,2} = V_T\ln\left(\frac{I_{C1}/I_{S1}}{I_{C2}/I_{S2}}\right), \quad \text{Eqn. 4}$$

$$I_{C1} = I_{C2} = I_C,$$

where $I_{S1}$ and $I_{S2}$ are the saturation currents respectively for the bipolar transistors used to form diodes D1 and D2 (e.g., see inset in FIG. 6), and $I_{C1}$ and $I_{C2}$ are currents through respective diode D1 and diode D2. Recalling that diode D2 is larger than diode D1, we have $I_{S2}=I_{S1}\times N$, where N is the ratio of the size of diode D2 to the size of diode D1. Eqn. 4 can be expressed as:

$$I_C\times R_1=\Delta V_{BE1,2}=V_T\ln(N). \quad \text{Eqn. 5}$$

Therefore, we can re-write Eqn. 1, as follows:

$$V_{BG} = V_{BE3} + (R_2/R_1) \times \Delta V_{BE1,2} = V_{BE3} + \frac{R_2}{R_1} \times V_T \ln(N) \quad \text{Eqn. 6}$$

A suitable bandgap voltage reference is as a voltage that does not change over temperature (T), which can be expressed in the following way: $\delta V_{BG}/\delta T=0$. To calculate $\delta V_{BG}/\Delta T$, first we need to know how saturation current $I_S$ changes versus temperature. In other words:

$$I_S = b \times T^{4+m} \exp\left(\frac{-E_g}{kT}\right) \quad \text{Eqn. 7}$$

where $I_S$ is saturation current, b is proportional to size of the bipolar transistor, m is about −1.5, and $E_g$ is the band-gap energy of silicon material, with which the bipolar transistor is made up and is equal to 1.12 eV (eV is electron voltage).

Next, we calculate the variation of $\delta(\Delta V_{BE1,2})/\delta T$ with the help of Eqn. 5:

$$\frac{\partial(\Delta V_{BE})}{\partial T} - \frac{k}{q}\ln(N). \quad \text{Eqn. 8}$$

Now, we calculate the variation of $V_{BE}$ of $\delta V_{BE}/\delta T$ using Eqns. 3 and 7:

$$\frac{\partial V_{BE}}{\partial T} = \frac{V_{BE} - (3+m)V_T - E_g/q}{T}. \quad \text{Eqn. 9}$$

With the help of Eqn. 6, the bandgap voltage variation versus temperature will be equal to:

$$\frac{\partial V_{BG}}{\partial T} = \frac{V_{BE3} - (3+m)V_T - E_g/q}{T} + (R_2/R_1) \times \frac{k}{q}\ln(N). \quad \text{Eqn. 10}$$

To have a fixed-band gap voltage that does not change with temperature, namely $\delta V_{BG}/\delta T=0$, we have:

$$(R_2/R_1) = -\left(\frac{V_{BE3} - (3+m)V_T - E_g/q}{T}\right) \Big/ \left(\frac{k}{q}\ln(N).\right) \quad \text{Eqn. 11}$$

Recalling that N is the ratio of the size of diode D2 to diode D1, the foregoing shows that the ratio of R2 to R1 needs to be selected depending on N in order to provide a bandgap voltage $V_{BG}$ that exhibits a small variation over temperature. However, as shown by Eqn. 11, the resistor ratio of $R_2/R_1$ also depends on the $V_{BE3}$ (voltage drop of diode D3). This means that due to process variations (process corners) of internal devices (e.g., the transistors which comprise the diodes) of a bandgap voltage reference circuit (e.g., the transistors which comprise the diodes), the accuracy of the bandgap voltage reference circuit will not be consistent from one chip to another, and therefore accurate measurement in many applications that use band-gap voltage can become degraded from one chip to another chip.

FIG. 2A illustrates an example of another conventional band-gap circuit where the current branch comprising the current source, resistor R2, and diode D3 may be replaced. Instead, a resistor R4 equal to R2−R1 is added in series with resistor R1. Both R2 and R4 may consist of a resistor array (see, for example, FIG. 2B), and may be adjusted by a calibration circuit (not shown). The value of R4 is the difference between the R2-array, and R1. Here the bandgap voltage $V_{BG}$ may be defined by Eqn. 6, but instead of $V_{BE3}$ we will have $V_{BE2}$.

The term "process corner" refers to variations in fabrication parameters on a semiconductor wafer of an integrated circuit. Process corners represent the extremes of these parameter variations within which the circuit must function correctly. A chip (e.g., a circuit design that includes a bandgap reference voltage generator) is typically fabricated on a wafer along with multiple other copies of the chip. The process corners of devices (e.g., transistors) on a given chip are essentially the same to within a small degree of variation. However, due to process variations across the wafer, the process corners of devices between chips on the same wafer may vary significantly. For example, the devices on one chip may be "fast", while the same devices on another chip may be "slow".

In the case of a bandgap voltage reference circuit, if the ratio of R2 to R1 is set for so-called "nominal" process corners, then chips whose devices have nominal process corners will behave as intended; in other words, their output voltage will vary within an acceptable range with changes in the ambient temperature. However, bandgap voltage reference circuits in chips that have fast or slow process corners, or any process corner other than a nominal process corner, may exhibit a wide swing in output voltage with changes in ambient temperature. Referring to FIG. 3, for example, a simulation is shown for bandgap voltage versus temperature for three typical process corners: fast, nominal, and slow. As can be seen, the voltage variation for a chip having nominal process corners, over a 120° C. temperature variation, is very small (e.g., <4 mV). The voltage variation for a slow corner chip over the same temperature range is high (e.g., >−9.3 mV, from low temperature to high temperature), and for a fast corner chip is also high (e.g., +7 mV). The bandgap voltage variation at nominal 27° C. temperature (equal to T=300° K) for different chip (for e.g. a fast-corner chip to a slow-corner chip) is very high as well.

Typically, manufacturers will use a programmable resistor array 202 (e.g., FIG. 2B) for one of the resistors, for example, resistor R2. The manufacturer can measure one or more parameters in each part and program the resistor array 202 in order to attain a suitable ratio of R2 to R1 according to the measurements. For example, a conventional approach is to measure a specific parameter (usually some reference voltage) for each part during a calibration process and burn some fuses of the resistor array 202 to set the switches of the resistor array to the OPEN or CLOSE thereby adjusting the value of R2 to attain the required $R_2/R_1$. This process tends to increase the calibration time for each part, and leads to increased cost.

SUMMARY

A bandgap voltage reference circuit comprises a voltage generating section and a calibration section. The voltage generating section may include a current generating part comprising a first resistor and first and second p-n junctions (e.g., diodes). A voltage across the first resistor is substantially equal to a difference between a voltage of the first p-n junction and a voltage of the second p-n junction. The current generating part produces a control signal for generating a current that is substantially equal to a current flowing through the first resistor. The current generating part may also serve to bias the first and second p-n junction diodes.

A calibration part comprises an internal reference voltage source configured to output an internal reference voltage level. A voltage source is configured to output a reference p-n junction voltage level (e.g., a voltage across a diode). A switch control circuit produces switch control signals based on the internal reference voltage level and the reference p-n junction voltage level. The switch control signals are coupled to set a resistance value of the second resistor.

In some embodiments, the internal reference voltage source comprises a second current source series-connected to a third resistor, wherein the internal reference voltage level is a voltage level generated across the third resistor when current flows from the second current source. The control signal from the current generating part may be further coupled to control the second current source.

The following detailed description and accompanying drawings provide a better understanding of the nature and advantages of the present disclosure.

DETAILED DESCRIPTION

In the following description, for purposes of explanation, numerous examples and specific details are set forth in order to provide a thorough understanding of the present disclosure. It will be evident, however, to one skilled in the art that the present disclosure as defined by the claims may include some or all of the features in these examples alone or in combination with other features described below, and may further include modifications and equivalents of the features and concepts described herein.

Figure 1:
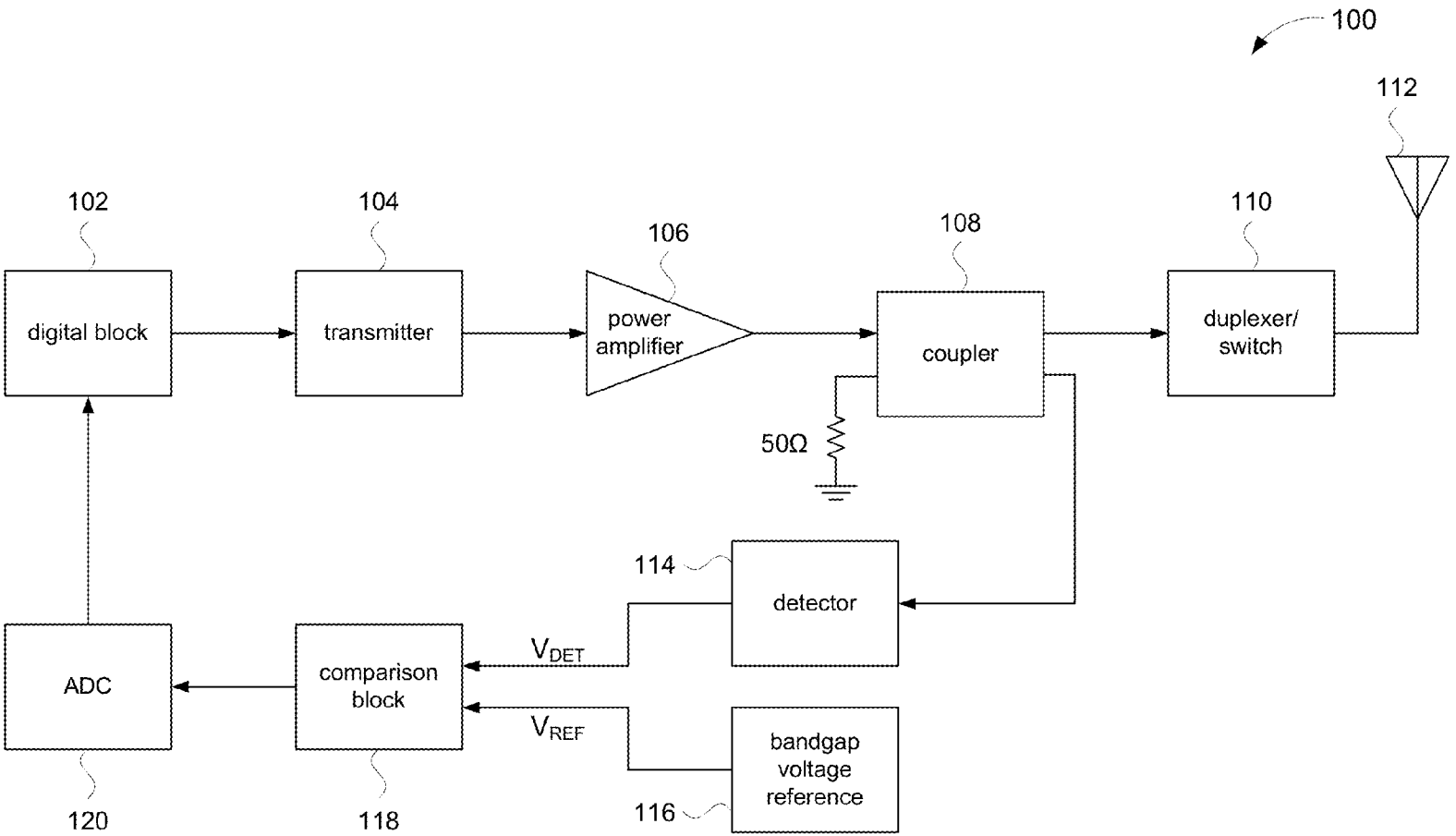
Fig. 1 (prior art)
FIG. 1 shows a typical circuit that employs a bandgap voltage reference.
Figure 2:
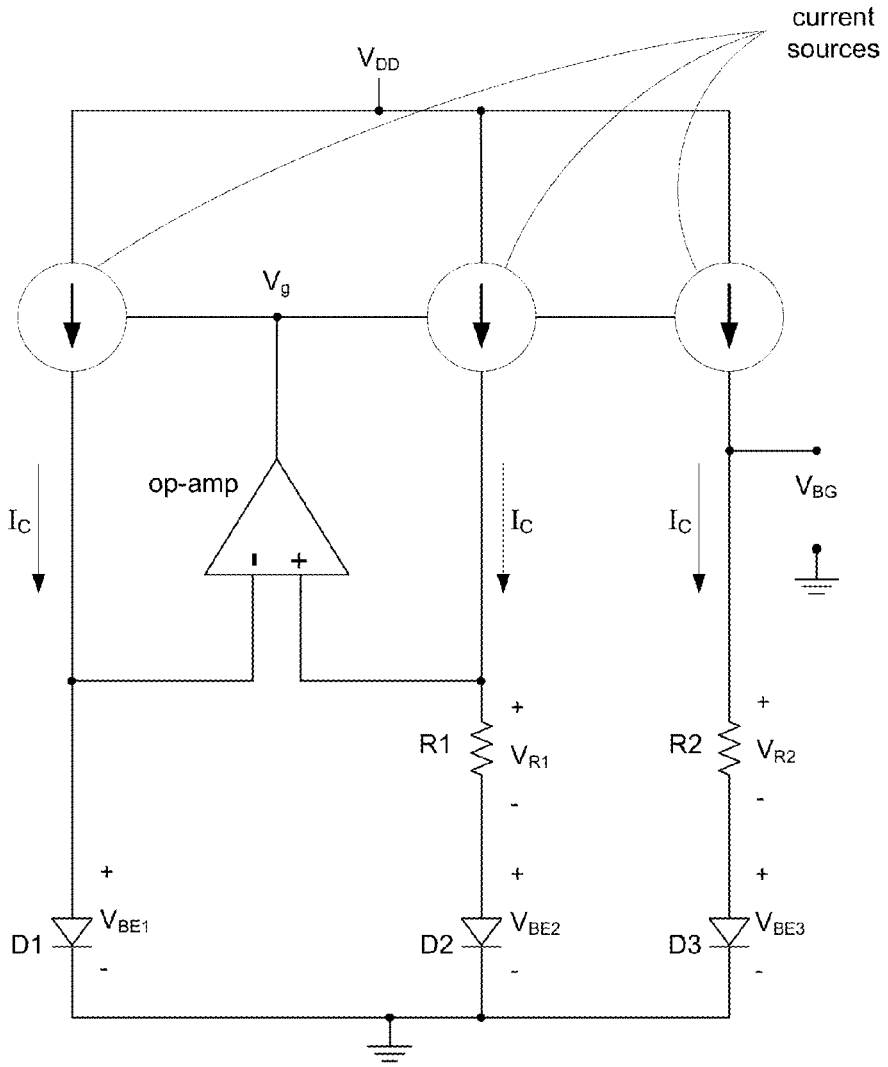
Fig. 2 (prior art)
FIGS. 2 and 2A illustrate a conventional bandgap voltage reference circuits.
Figure 2A:
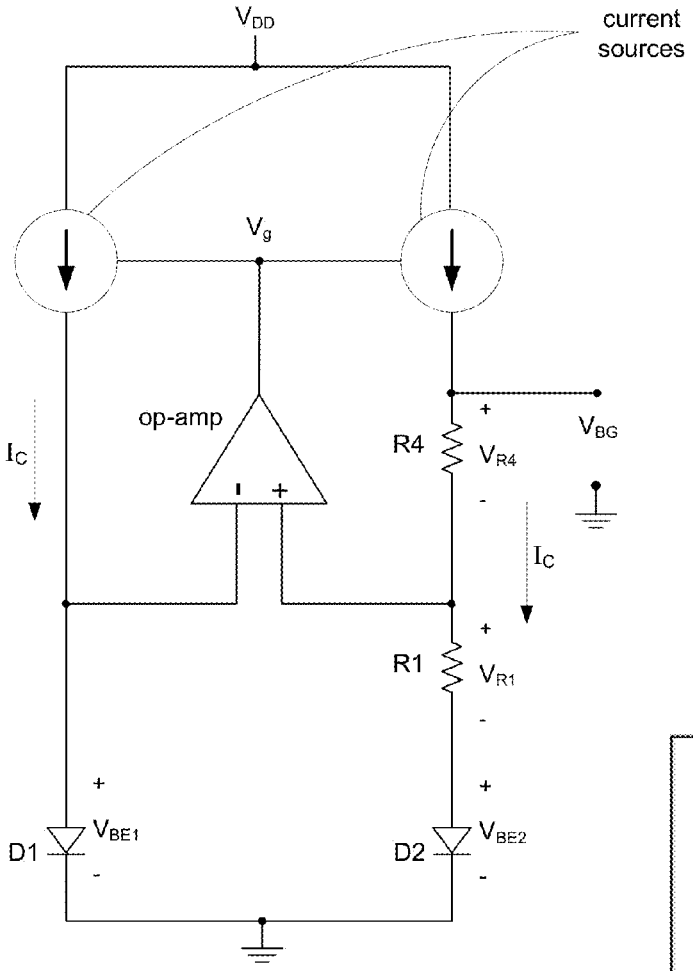
Fig. 2A (prior art)
Figure 2B:
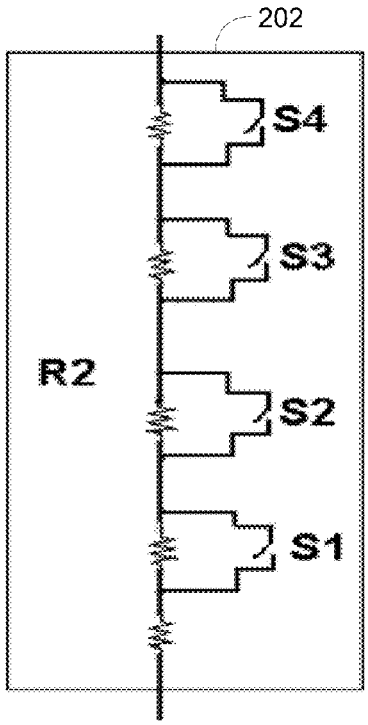
FIG. 2B shows a programmable resistor that may be employed in the bandgap voltage reference circuit shown in FIG. 2.
Figure 4A:
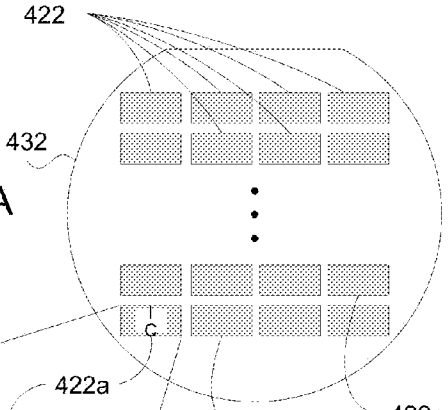
FIGS. 4A-4C illustrates a bandgap voltage reference circuit in accordance with the present disclosure in a circuit design that can be manufactured as chips formed on a wafer.
Figure 4B:
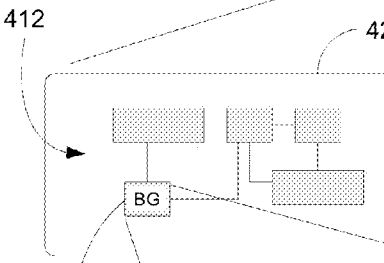
Figure 4C:
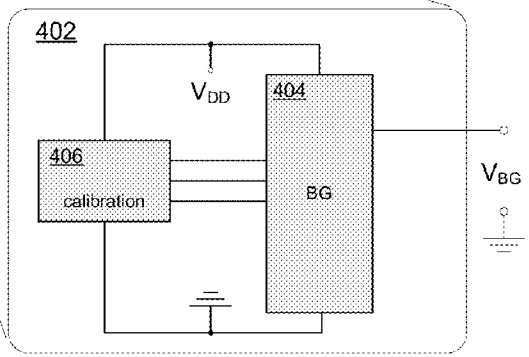
Figure 3:
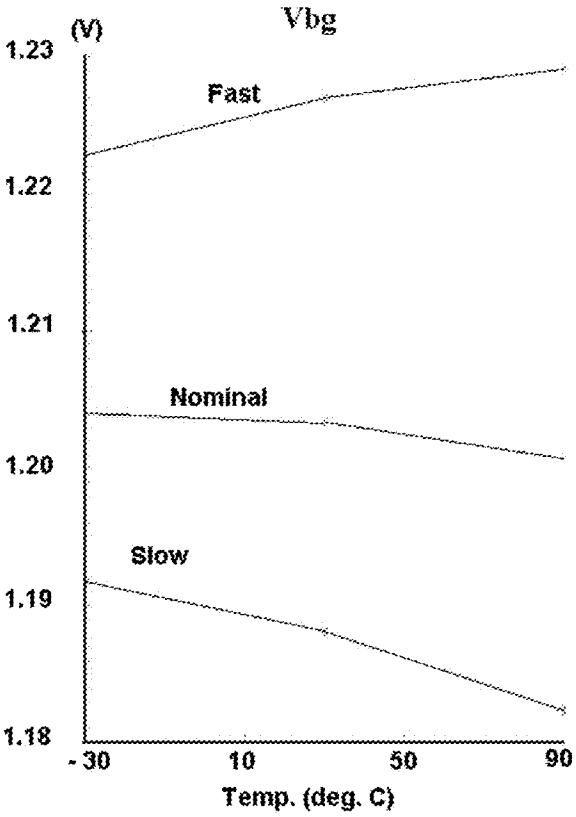
FIG. 3 illustrates bandgap voltage variations over a given temperature range for the bandgap voltage reference circuit of FIG. 2 with different process corners.

Referring to FIGS. 4A-4C, in accordance with principles of the present disclosure a bandgap voltage reference source 402 comprises a bandgap voltage generating section 404 and a calibration section 406. The bandgap voltage reference source 402 outputs a voltage level $V_{BG}$. The details of this circuit will be discussed below. In some embodiments, the bandgap voltage reference source 402 may be incorporated as a component in a larger circuit design 412. The automatic power control circuit shown in FIG. 1, for example, is an example of a circuit design 412 that may incorporate the bandgap voltage reference source 402 of the present disclosure. The circuit design 412, in turn, may be incorporated on an Integrated Circuit (IC) chip 422*a*. The IC chip 422*a* is typically one among a plurality of chips 422 fabricated on a semiconductor wafer 432.

It is understood that process variations during semiconductor manufacture exists. Process variations occur from one wafer to another wafer, and indeed may occur on a per wafer basis. In other words, process variations may occur from one chip 422*b* to another chip 422*c*, and may even arise between adjacent chips 422*a* and 422*b*. And, as explained above, some circuits such as bandgap voltage references may need to be individually calibrated in order to compensate for resulting variations in device process corners.

Figure 5:
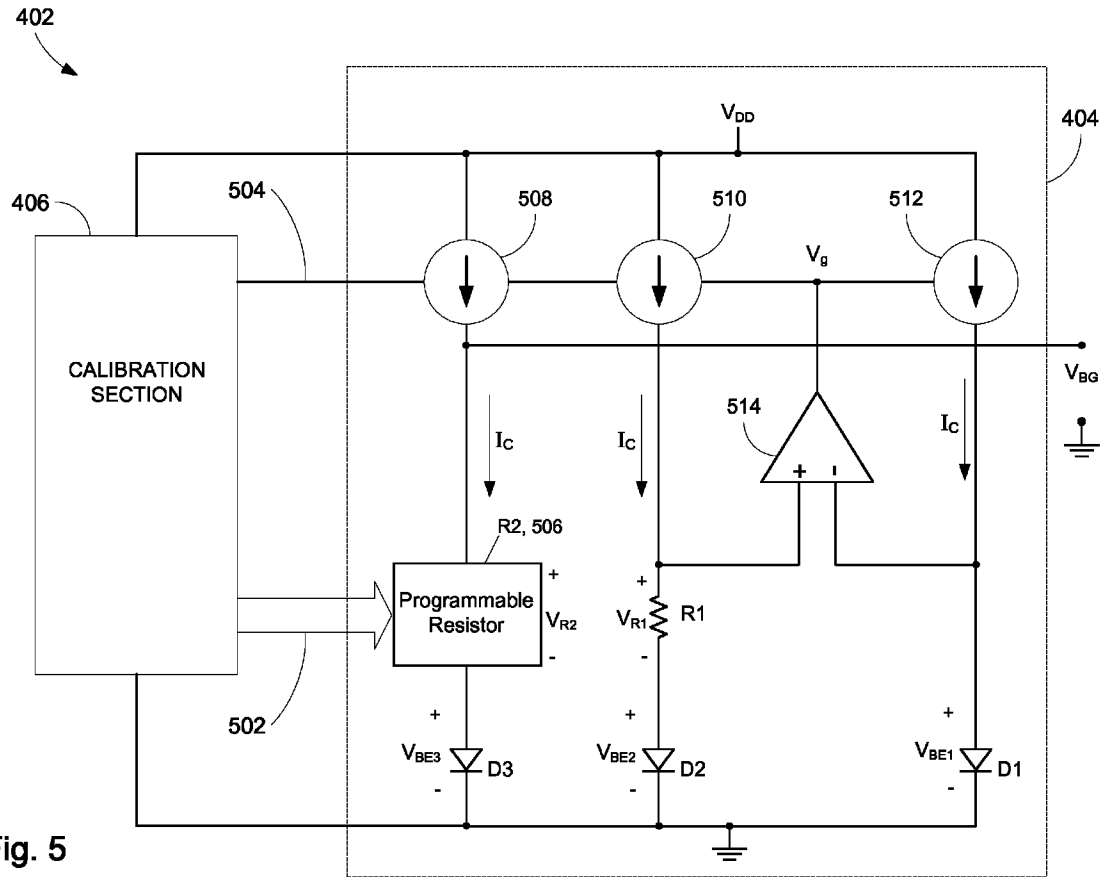
FIG. 5 shows an aspect of an embodiment of a bandgap voltage reference circuit in accordance with the present disclosure.

Referring to FIG. 5, in some embodiments, the bandgap voltage generating section 404 of the bandgap voltage reference source 402 may comprise a current generating part and a voltage generating part. The current generating part of the bandgap voltage reference source 402 may include current sources 510 and 512, controlled by an op-amp 514. The current source 512 provides current down to a current branch comprising a p-n junction, e.g., diode D1. In some embodiments, the diode D1 may be provided by a bipolar transistor configured with its base and collector terminals connected together. A forward bias voltage $V_{BE1}$ across diode D1 is connected to an inverting input of op-amp 514. Another current source 510 provides current down to a current branch comprising a resistor R1 and another p-n junction, namely diode D2. As with diode D1, the diode D2 may be provided by a bipolar transistor configured with its base and collector terminals connected together. A voltage level equal to the sum of a voltage $V_{R1}$ across the resistor R1 and a voltage $V_{BE2}$ across the diode D2 is connected to a non-inverting input of op-amp 514. Diode D2 is selected to be larger than diode D1, and thus D1 will carry less current than diode D2. In some embodiments, the current sources 510 and 512 are fabricated with devices having the same design parameters, and so each current source will produce substantially the same current when controlled by the same control signal (e.g., $V_g$). Accordingly, an output $V_g$ of the op-amp 514 controls the current sources 510 and 512 to source an amount of current $I_C$ to force the condition $V_{BE1}=V_{BE2}+V_{R1}$.

The voltage generating part of the bandgap voltage reference source 402 comprises a current source 508 providing current down a current branch having a second resistor R2 and a diode D3 (another p-n junction). The output $V_g$ also controls the current source 508 to source the same amount of current $I_C$ through resistor R2 and diode D3. In some embodiments, the current source 508 is fabricated with devices having the same design parameters as the devices of current source 510 (and 512), and so current source 508 will produce substantially the same current as current source 510 when controlled by the same control signal (e.g., $V_g$). A voltage level equal to the sum of a voltage $V_{R2}$ across resistor R2 plus a voltage $V_{BE3}$ across the diode D3 constitutes an output voltage reference $V_{BG}$ of the bandgap voltage reference source 402. In accordance with principles of the present disclosure, the resistor R2 may be a programmable resistor device 506.

In some embodiments, the bandgap voltage generating section 404 provides the op-amp output $V_g$ as a control signal 504 to the calibration section 406 of the bandgap voltage reference source 402. As will be explained, the calibration section 406 generates switch control signals 502 to program the programmable resistor device 506 to set a resistance value for the resistor R2.

Figure 6:
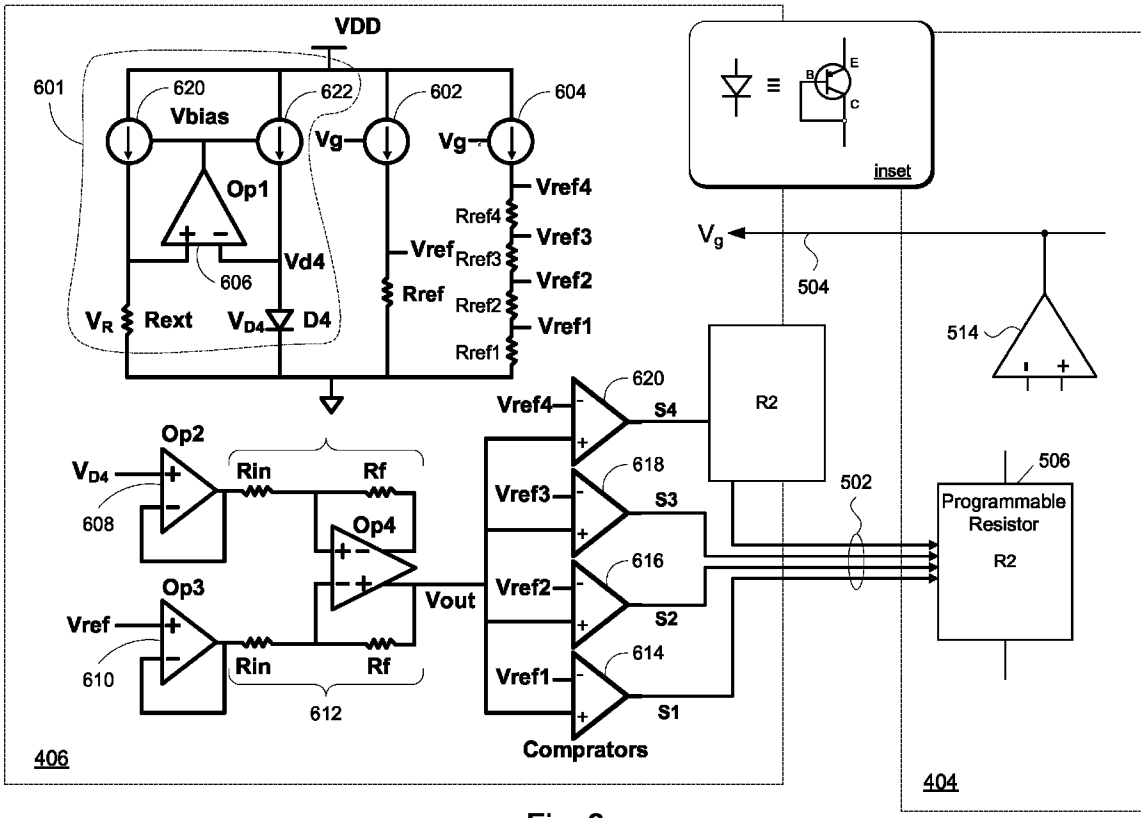
FIG. 6 shows another aspect of an embodiment of a bandgap voltage reference circuit in accordance with the present disclosure.

Referring to FIG. 6, details of the calibration section 406 in accordance with embodiments of the present disclosure will be described. An internal reference voltage source comprises a current source 602 providing current through a resistor Rref, and a current source 604 providing current through a resistor ladder compromising resistors Rref1, Rref2, Rref3, and Rref4. The current sources 602 and 604 are controlled by the control signal 504, which is the output $V_g$ of op-amp 514 in the bandgap voltage generating section 404. In some embodiments, the current sources 602 and 604 may be fabricated with devices having the same design parameters as the devices which comprise current source 508 shown in FIG. 5 (also current sources 510 and 512). Accordingly, current sources 602 and 604 will produce substantially the same current as current source 508 when controlled by the same control signal (e.g., $V_g$).

Voltages $V_{REF}$, $V_{REF1}$, $V_{REF2}$, $V_{REF3}$, and $V_{REF4}$ are generated across resistors Rref and Rref1, Rref2, Rref3, and Rref4, respectively. These voltages serve as internal reference voltages used by the calibration section 406. In a particular embodiment, for example, the internal reference voltages $V_{REF1}$, $V_{REF2}$, $V_{REF3}$, and $V_{REF4}$ are inputs into the inverting inputs of respective comparators 614, 616, 618, and 620. The internal reference voltage $V_{REF}$ serves as a reference voltage in an amplifier-stage 612 in the calibration section 406. The amplifier-stage 612 includes two input resistors ($R_{in}$) a differential op-amp (Op4) and two feedback resistors ($R_f$) around the op-amp.

The automated calibration for setting the required $R_2$ value for each process corner of bipolar devices is shown in FIG. 6. D4 is a replica diode of diodes D1, D2, and D3. A replica-voltage generator section 601 comprises an op-amp (Op1) 606, resistor $R_{ext}$ connected to a non-inverting input of the op-amp, and diode D4 connected to an inverting input of the op-amp. Two current sources 620 and 622 are controlled by output $V_{bias}$ of op-amp 606. If the resistor $R_{ext}$ has a small resistance variation a substantially constant voltage can be maintained across diode D4. In some embodiments, the resistor $R_{ext}$ may be an external (i.e., not on the chip) resistor with typical variation of +/−1%. In other embodiments, the resistor $R_{ext}$ may be an on-chip resistor (i.e., on the same chip as the calibrated band-gap circuit). For example, the on-chip resistor would be calibrated first, based on an external resistor, to within +/−5%.

In operation op-amp 606 forces the voltage over the $R_{ext}$ ($V_R$) to be the same as $V_{D4}$, by changing the $V_{bias}$. Basically the output of op-amp 606 generates same current value for two identical current sources 620 and 622. $V_{D4}$ is compared to a reference voltage ($V_{REF}$), to sense the how much the diode-voltage is deviating from a constant reference voltage ($V_{REF}$). The difference ($V_{D4}$-$V_{REF}$) is amplified by the amplifier-stage 612, and then compared to the constant reference voltages (e.g. $V_{REF1}$, $V_{REF2}$, $V_{REF3}$, and $V_{REF4}$) via several comparators 614-620. The outputs(e.g. S1, S2, S3, and S4) 502 of the comparators, each is either logic-zero or a logic-one. These outputs 502 are applied to the switches inside the R2 resistor-array 506 inside the bandgap voltage generating section 404 to set a correct ratio of $R_2/R_1$ for different process corners for different chips. Therefore different chips will generate the same band-gap voltage reference despite variations in the process corners from one chip to the next.

In embodiments, the op-amp (Op2) 608, and op-amp (Op3) 610 serve to buffer the diode-voltage ($V_{D4}$) and the $V_{REF}$ voltage, before applying to input ports (namely, input resistors $R_{in}$) of amplifier-stage 612. These "op-amp buffers" 608 and 610 prevent the amplifier-stage 612 from changing the diode voltage $V_{D4}$ and the reference voltage ($V_{REF}$), respectively, when $V_{REF}$ and $V_{D4}$ are connected to the input ports of the amplifier-stage 612. The buffer 610 provides isolation between the amplifier-stage 612 and the reference voltage branch (resistor $R_{ref}$ and current source 602) that generates the $V_{REF}$. The buffer 608, similarly, isolates the amplifier-stage 612 from the replica-voltage generator section 601 which generates $V_{D4}$.

The small variations of the diode-voltage ($V_{D4}$) over different process corner for the diode D4, will lead to much bigger variation at output $V_{out}$ of the amplifier-stage 612. This relaxes the requirement for comparator offset voltage and the accuracy of the references voltages to the comparators 614-620. Note that all of the reference voltages ($V_{REF}$, $V_{REF1}$, $V_{REF2}$, $V_{REF3}$, and $V_{REF4}$) controlled by $V_g$ (output of the op-amp 514) inside the bandgap voltage generating section 404 have the same voltage value for different chips with different process corners. These reference voltages only depend on the temperature, which means these reference voltage are PTAT voltages.

Basically, as Eqn. (4) shows, the current produced by each current source 602 and 604, controlled by $V_g$, can be shown by Eqn. 12 below. The ratio of two resistors (e.g., Rref and $R_1$), both on-chip resistors, may be made to be very accurate, typically <0.1%. So at the same temperature (e.g., nominal 27° equal to T=300° K), these reference voltages have the same value for different chips.

$$I_C = V_T \ln(N)/R_1 \quad \text{Eqn. 12}$$

$$V_{REF} = I_C \times R_{ref} = V_T \ln(N) \times \left(\frac{R_{ref}}{R_1}\right) = \frac{KT}{q} \ln(N) \times \left(\frac{R_{ref}}{R_1}\right) \quad \text{Eqn. 13}$$

Outputs S4, S3, S2, and 51 of respective comparators 614-620 constitute the switch control signals 502 that are connected to programming inputs of the programmable resistor 506. Each output S4, S3, S2, and S1 will be at voltage levels suitable for programming the programmable resistor 506.

Figure 6A:
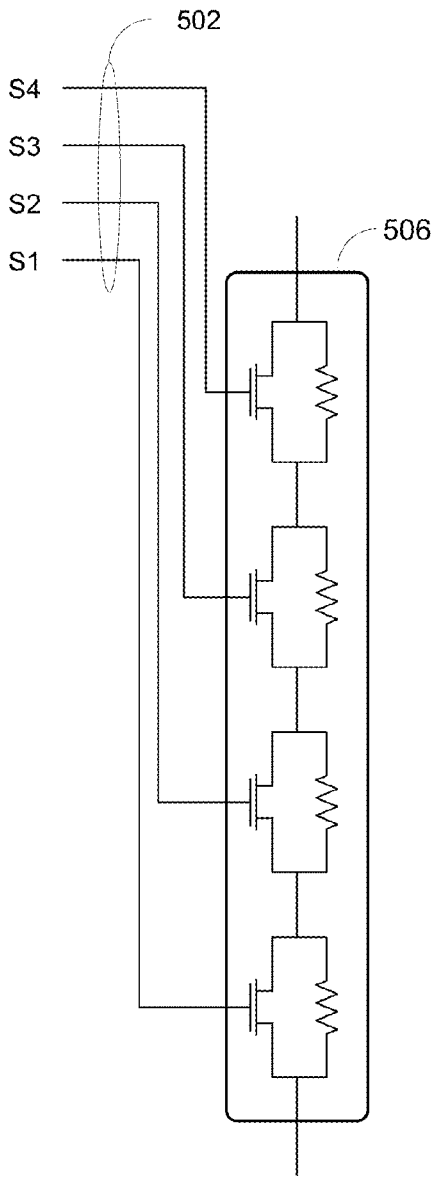
FIG. 6A illustrates a programmable resistor connected in accordance with the present disclosure.

FIG. 6A shows an example of a programmable resistor 506 that may be programmed by the switch control signals 502. In some embodiments, the outputs S4, S3, S2, and 51 may be stored in a memory (not shown) so that the calibration need be performed only once. The memory may be on-board such as a flash memory, or may be off-chip (e.g., a separate static random access memory device).

In some embodiments, the diode D4 may be fabricated from a bipolar transistor by connecting together the base and collector terminals, as illustrated by the inset in FIG. 6. It is known that variations of a voltage $V_{D4}$ (=$V_{BE4}$) across the diode D4 over temperature is dependent on the actual value of $V_{D4}$. Basically, if $V_{BE}$ (base emitter voltage) of a bipolar transistor is smaller (or bigger) for a specific process corner, compared to the nominal corner, the quantity $\delta V_{BE}/\delta T$ will also be smaller (or bigger) for this corner. This means, as shown in Eqn. 11, that higher (or smaller) $R_2/R_1$ (compared to the $R_2/R_1$ ratio selected based on nominal process corner for the diode), is required to generate a constant band-gap voltage ($\delta V_{BG}/\delta T=0$).

Therefore, if the variations of $V_{BE4}$ for each process corner are known, the required resistor ratio of ($R_2/R_1$), which depends on the $\delta V_{BE}/\delta T$, can be found by generating a difference with a reference voltage ($V_{REF}$). This difference is then amplified ($V_{out}$) and then will be compared to several reference voltages using the comparators 614-620. Accordingly, the voltage $V_{D4}$ across diode D4 may serve as a voltage that is representative of each of the voltages $V_{BE1}$ (=$V_{D1}$), $V_{BE2}$ (=$V_{D2}$), and $V_{BE3}$ (=$V_{D3}$) under the same conditions. As such, the diode D4 may be referred to as a "replica" of the diodes D1, D2, and D3 in the bandgap voltage generating section 404.

However, the variations of $V_{D4}$ over different process corners of the diode D4 is small (e.g., <10-30 mV). In other words, the $V_{D4}$ of diode D4 on one chip (e.g., 422*a*, FIG. 4A) may differ from the $V_{D4}$ of diode D4 on another chip (e.g., 422*c*) by <30 mV. In other words, the comparators 614-620 would have to be able to detect voltage levels with resolution on the order of 0.03V. Such resolution imposes tight requirements for the comparators 614-620 in terms of offset voltage characteristics, and high accuracy for the reference voltages $V_{REF1}$, $V_{REF2}$, $V_{REF3}$, and $V_{REF4}$ supplied to the comparators.

Accordingly, some embodiments of the present disclosure may employ the gain stage arrangement described above and shown in FIG. 6. The amplifier-stage 612 is configured to amplify the voltage level $V_{D4}$ across diode D4. In some embodiments, the gain stage 612 may be sensitive only to the ratio of two resistors (e.g. $R_f$ and $R_{in}$). Both of these resistors are on-chip resistors and the ratio between them is very accurate (typically <0.1%). Here, the amplified voltage $V_{out}$ of the amplifier-stage 612 will exhibit a large enough variation (for e.g. >400 mV) before applying to the non-inverting input of comparators 614-620, to relax the offset voltage requirement for the comparators and the accuracy of the reference voltages ($V_{REF1}$, $V_{REF2}$, $V_{REF3}$, and $V_{REF4}$) to the comparators, since the required resolving voltage in the comparators is decreased by about an order of magnitude.

The bias current of replica diode (D4) and therefore voltage level $V_{D4}$ across diode D4 is dependent on the value of resistor $R_{ext}$. Accordingly resistor $R_{ext}$ may be externally provided (i.e., "off chip") so that a high precision resistor (e.g., having +/−1% tolerance or better) may be employed. In an embodiment, the resistor $R_{ext}$ may be provided on chip; however, a trimming step may be needed to attain a sufficiently high precision (e.g., to within +/−5%) of resistance.

Figure 7:
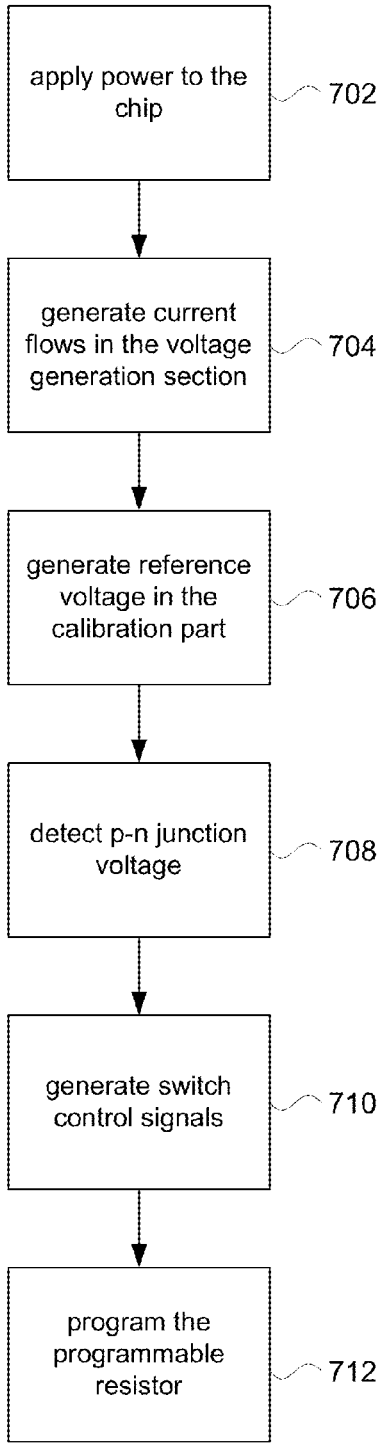
FIG. 7 shows a calibration process.

Referring to FIG. 7, a calibration process is described. At 702, the power is applied to a chip that incorporates a bandgap voltage reference source in accordance with the principles of the present disclosure; for example, the circuit of FIGS. 5 and 6. At 704, current flows in the voltage generating section 404 are produced, as the op-amp 514 operates (via $V_g$) the current sources 510 and 512 to create a current $I_C$.

At 706, the same current $I_C$ is generated through resistors Rref, Rref1, Rref2, Rref3, and Rref4 in the calibration section 406 by virtue of the current sources 602 and 604 being operated by the same control signal $V_g$. The current creates a voltage across each resistor Rref, Rref1, Rref2, Rref3, and Rref4, setting up the reference voltages $V_{REF}$, $V_{REF1}$, $V_{REF2}$, $V_{REF3}$, and $V_{REF4}$.

At 708, the voltage $V_{D4}$ across the diode D4 is detected and amplified to produce $V_{out}$. At 710, $V_{out}$ are compared against several reference voltages, ($V_{REF1}$, $V_{REF2}$, $V_{REF3}$, and $V_{REF4}$,) using the comparators 614-620 to produce the switch control signals 502. The switch control signal 502 then program the programmable resistor 506 at 712 by virtue of the outputs of comparators 614-620 being connected to the programming inputs of the programmable resistor.

Figures 8A, 8B, 8C:
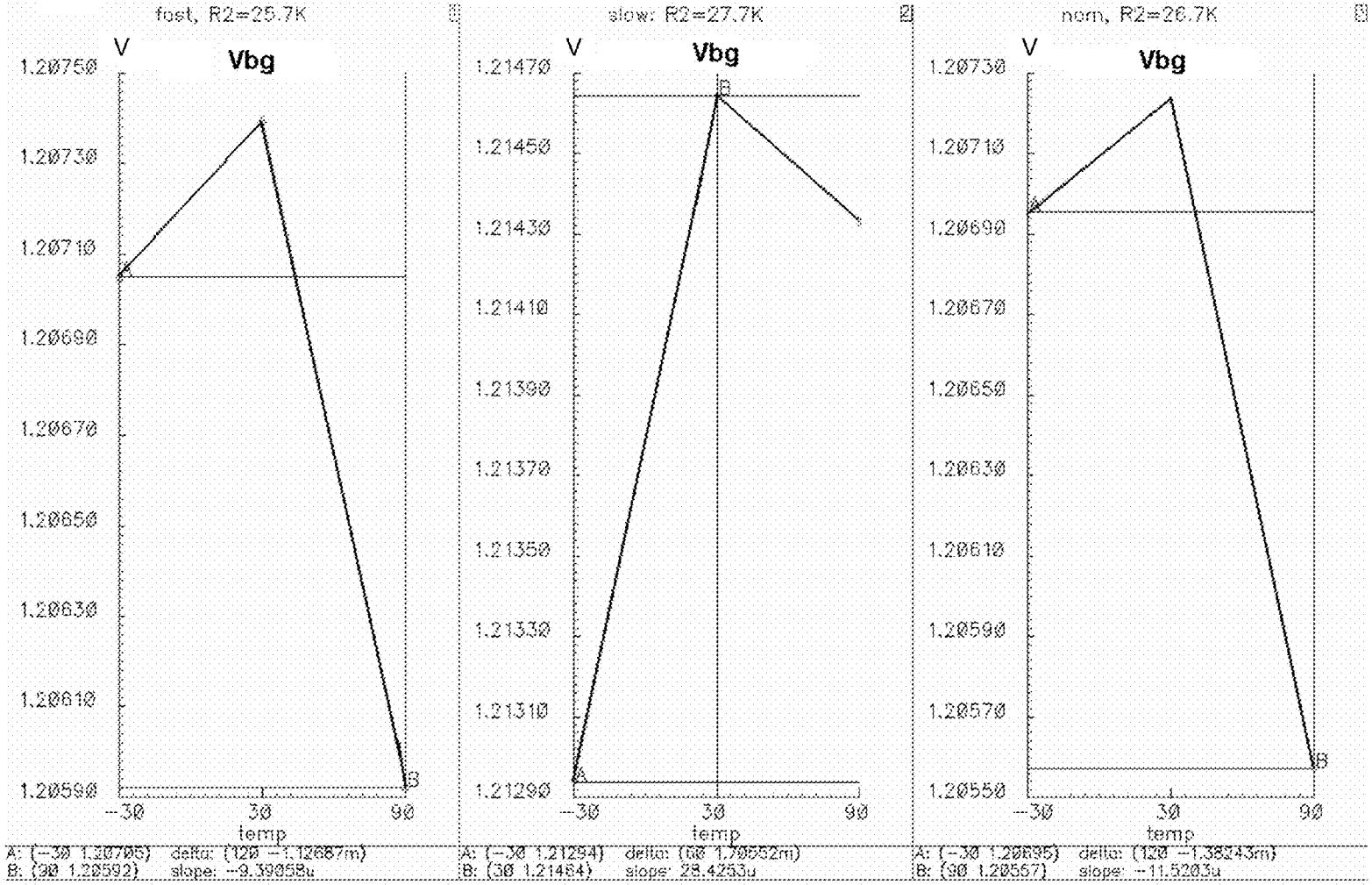
FIGS. 8A-8C are simulation results of a bandgap voltage reference circuit in accordance with the present disclosure showing its $V_{BG}$ performance over different process corners.

Simulations of a bandgap voltage reference source (e.g., 402, FIG. 5) in accordance with the present disclosure reveal the effectiveness of the calibration process. FIGS. 8A-8C represent an example of simulation results of bandgap voltage variation over temperature for a bandgap voltage reference source circuit for three different process corners: fast (FIG. 8A), slow (FIG. 8B), and nominal (FIG. 8C). The temperature variation spans 120° C. from −30° C. to +90° C. For the "fast corner" case, the value of R2 was set to 25.7KΩ (lower than 26.7KΩ required for a "nominal coroner") by the calibration section 406. The resulting variation in bandgap voltage $V_{bg}$ is quite narrow, ranging from a maximum of about 1.2074V to a minimum of 1.2059V, which for many applications may be a very acceptable range. A similar result is obtained for the "slow corner" case in FIG. 8B, but with a higher R2 value (27.7K) as compared to the nominal R2 value of 26.7KΩ. The "nominal corner" case of FIG. 8C may serves as a reference for comparison. The values of R2 may vary +/−1KΩ relative to the nominal corner case. In addition, the band-gap voltage variation at nominal 27° C. temperature, (equal to T=300° K), for different chips (e.g., a fast-corner chip to a slow-corner chip) after using the calibration procedure is very small (e.g., <<10 mV).

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The above description illustrates various embodiments of the present disclosure along with examples of how aspects of they may be implemented. The above examples and embodiments should not be deemed to be the only embodiments, and are presented to illustrate the flexibility and advantages of the present disclosure as defined by the following claims. Based on the above disclosure and the following claims, other arrangements, embodiments, implementations and equivalents will be evident to those skilled in the art and may be employed without departing from the spirit and scope of the claims.

What is claimed is:

1. A circuit comprising:

a first circuit part comprising op-amp, a first resistor, and first and second p-n junctions, and configured to produce a voltage across the first resistor substantially equal to a difference between a voltage of the first p-n junction and a voltage of the second p-n junction;

a second circuit part comprising a series connection of a current source, a second resistor, and a third p-n junction;

a control signal from the first circuit part coupled to the current source in the second circuit part to generate a current flow in the second circuit part that is substantially equal to a current flowing through the first resistor;

an output terminal configured to output a voltage level substantially equal to a voltage across the second resistor and a voltage across the third p-n junction; and a calibration circuit comprising:

an internal reference voltage source configured to generate one or more internal reference voltage levels;

a p-n junction voltage source configured to output a reference p-n junction voltage level;

an amplifier configured to output a difference signal indicative of a difference between one of the internal reference levels and the reference p-n junction voltage level; and a switch control circuit connected to the internal reference voltage source and to the amplifier, and configured to output switch control signals based on the internal reference voltage levels and a difference between two input signals to the amplifier, the switch control signals being coupled to set a resistance value of the second resistor, wherein the resistance value of the second resistor is set in accordance with the switch control signals.

2. The circuit of claim 1 wherein the internal reference voltage source comprises a second current source series-connected to a third resistor, wherein the internal reference voltage level is a voltage level generated across the third resistor when current flows from the second current source.

3. The circuit of claim 2 wherein the internal reference voltage source comprises a third current source series-connected to a resistor chain, wherein the control signal from the first circuit part is further coupled to control the second current source and the third current source.

4. The circuit of claim 1 wherein the p-n junction voltage source comprises an op-amp, a diode connected to an input of the op-amp, a resistor connected to another input of the op-amp, and two current sources connected to an output of the op-amp.

5. The circuit of claim 4 wherein the diode is a bipolar transistor configured as a diode.

6. The circuit of claim 4 wherein one of the two current sources provides current through the diode to produce a voltage across the diode that is input to the op-amp.

7. The circuit of claim 6 wherein another of the two current sources provided current through the resistor to produce a voltage across the resistor that is input to the op-amp.

8. The circuit of claim 1 wherein the switch control circuit comprises a plurality of comparators, wherein each comparator has a first input connected to one of the internal reference voltage levels and a second input connected to the output of the amplifier.

9. A circuit comprising:

means for generating a bandgap voltage level including first and second resistors and a current control signal, wherein the current control signal is based on a voltage across the first resistor, wherein the current control signal is used to generate a current flow through the second resistor and to generate a voltage across a p-n junction, wherein the bandgap voltage level is equal to a sum of a voltage across the second resistor and the voltage across the p-n junction, wherein the second resistor is programmable;

means, connected to the second resistor, for programming the second resistor comprising:

first means, connected to the current control signal, for generating a plurality of internal reference voltages based on the current control signal;

second means for generating a reference p-n junction voltage level; and third means for producing switch control signals based on the reference p-n junction voltage level and the one or more internal reference voltages, wherein the switch control signals are connected to the second resistor, wherein the resistance value of the second resistor is set in accordance with the switch control signals.

10. The circuit of claim 9 wherein the first means comprises a first current source connected to the current control signal and a third resistor connected to the current source, wherein a first internal reference voltage level is a voltage level generated across the third resistor when current flows from the first current source.

11. The circuit of claim 9 wherein the second means comprises an op-amp, a diode connected to an input of the op-amp, a resistor connected to another input of the op-amp, and two current sources connected to an output of the op-amp.

12. The circuit of claim 11 wherein the diode is a bipolar transistor configured as a diode, wherein one of the two current sources provides current through the diode to produce a voltage across the diode that is input to the op-amp, wherein another of the two current sources provided current through the resistor to produce a voltage across the resistor that is input to the op-amp.

13. The circuit of claim 9 wherein the third means comprises a plurality of comparators, wherein each comparator has a first input connected to one of the internal reference voltage levels and a second input connected to a signal based on a difference between the reference p-n junction voltage level and another of the internal reference voltage levels.

14. A method in a voltage reference circuit comprising:

generating a first current flow through a first p-n junction of the voltage reference circuit;

generating a second current flow through a second p-n junction and a first resistor of the voltage reference circuit;

generating a third current flow through a third p-n junction and a second resistor of the voltage reference circuit, wherein the first, second, and third current flows are substantially equal, wherein a voltage across the third p-n junction and a voltage across the second resistor constitute an output reference voltage level of the voltage reference circuit; and calibrating the second resistor, comprising:

generating a plurality of internal reference voltages;

detecting a voltage level across a fourth p-n junction;

generating switch control signals based on a detected voltage across the fourth p-n junction and the internal reference voltages, including a difference between the detected voltage and one of the internal reference voltages; and setting a value of the second resistor using the switch control signals, wherein sensitivity of the output reference voltage level to variations in ambient temperature is based on a ratio of resistance values of the first resistor and the second resistor.

15. The method of claim 14 wherein the second resistor is a programmable resistor and the switch control signals program the programmable resistor.

16. The method of claim 14 wherein generating the internal reference voltages includes generating a fourth current flow through a third resistor, wherein the internal reference voltage is a voltage across the third resistor.

17. The method of claim 14 wherein a current density of the first p-n junction is different from a current density of the second p-n junction.

18. The method of claim 14 wherein each p-n junction is a diode.

19. The method of claim 14 wherein each p-n junction is a bipolar transistor having a base terminal connected to collector terminal.

20. The method of claim 14 further comprising amplifying the difference between the detected voltage and said one of the internal reference voltages to generate an amplified voltage level.

* * * * *